United States Patent [19]

Spyra

[11] Patent Number: 4,875,668

[45] Date of Patent: Oct. 24, 1989

[54] HIGH SPEED SHEET FOLDER AND PRESSER FOR AUTOMATED MAILING SYSTEMS

[75] Inventor: Rudolf A. Spyra, Tucson, Ariz.

[73] Assignee: Computer Output Processors and Engineering, Inc., Tucson, Ariz.

[21] Appl. No.: 187,084

[22] Filed: Apr. 28, 1988

[51] Int. Cl.[4] ..... B42C 1/00

[52] U.S. Cl. ..... 270/45; 270/32

[58] Field of Search ..... 270/20.1, 21.1, 32, 270/45, 51, 54, 55, 57, 58

[56] References Cited

U.S. PATENT DOCUMENTS

| | | | |
|---|---|---|---|
| 4,033,807 | 7/1977 | Neill et al. | 270/58 |
| 4,223,882 | 9/1980 | Stocker | 270/45 |

FOREIGN PATENT DOCUMENTS

| | | | |
|---|---|---|---|
| 38942 | 11/1981 | European Pat. Off. | 270/37 |
| 233112 | 2/1986 | Fed. Rep. of Germany | 270/55 |
| 25703360 | 3/1986 | France | 270/55 |
| 98055 | 7/1980 | Japan | 270/37 |

*Primary Examiner*—Robert E. Garrett
*Assistant Examiner*—Therese M. Newholm
*Attorney, Agent, or Firm*—James T. FitzGibbon; Angelo J. Bufalino

[57] ABSTRACT

A mail processing machine which includes a folder bar, a creasing element and pressing roller assembly for maintaining an array of sheets in a folded over form in a reduced height stack for insertion into mailing envelopes. A table supports the lower surface of sheets to be processed by the machine, pusher bars engage and intermittently advance the sheets downstream of said machine. The folder bar extends transversely of the downstream direction and is arcuately movable to impart a fold to the array of sheets. A creasing element moves up to engage the lower surface of the stack, and two opposed pressing rollers, each with its own drive mechanism, are resiliently urged together to apply a pressing force to the array of sheets passing between the rollers.

21 Claims, 10 Drawing Sheets

72
58
57
96
M
LE
88
90
61
59
72
60
82
80
87
86
C
92

LE
M
94
72
88
90
81
62
82
FE
80
C
92
LE
80
96
94
78
FE 88
62
71
60
170
C
81
77
96
FE 57
170
71
C
FE 72
61
57
77
C
92

58
72
59
60
6a
136
138
92
90
150
86
148
84
146
144
142
170
82
162
160
156
164
166
168
140
"M"
77
57
158
152
154
94

"L"
314
224
222
242
198
240
244
312
310
122
192
218
174
204
228
232
226
230

HIGH SPEED SHEET FOLDER AND PRESSER FOR AUTOMATED MAILING SYSTEMS

BACKGROUND OF THE INVENTION

The present invention relates generally to mailing machines, and more particularly, to improved mailing machines of the type where an assemblage of documents or "mailing" processed by the machine includes a plurality of elements which are individually directed to the customer, such as the pages of a bill, and wherein other elements, such as mailing envelopes, return envelopes, data processing cards, informational circulars and advertising, are not so directed. These materials are collectively referred to herein as "inserts"; these so-called inserts, in contrast to the bill pages, need not be uniquely addressed or addressable.

According to the present invention, an improved high speed apparatus is provided for imparting a proper folding and pressing action to insure that the contents of the envelope may be readily and reliably inserted into a mailing envelope. This insures that the user is presented with an orderly, unitary array of mailed materials which is self-contained and the elements of which do not require re-assembly after removal from the envelope.

High speed automated mailing systems are known, including those which can process many thousand mailings per hour. However, as is the case with many highly engineered products, there is still room for improvement in certain aspects of machine operation. In particular, there is a short coming in existing commercial machines in the area of properly folding and pressing a package or bundle of assorted materials into a unitary package for insertion into an envelope. In this connection, certain folding mechanisms are unable to provide a satisfactory fold to more than two or three sheets, and consequently must fold a fifteen sheet mailing, for example, by individually folding the mailing in three groups of five sheets each. This presents the user with the problem of receiving a number of separate components in the mail envelope, which must somehow be sorted by the customer in order to be fully understood or dealt with.

Other folder apparatus is available which is able to fold a larger number of sheets, but, owing to the intermittent operational nature of such machines, once a fold has been imparted to a set of envelope contents, the package may not remain flat for the time required to insert the mailing into the envelope, and/or may unduly bias the mailing envelope open and render it difficult to seal.

As used herein the expression "mailing" is intended to apply to a group of materials intended to be sent to a single customer, exclusive of the exterior mailing envelope; the mailing plus the exterior envelope is sometimes referred to herein as the package.

According to the invention, a folder unit is combined with a novel pressing roller assembly which has a number of desirable advantages and characteristics in use, including the ability to impart a flatter profile to a mailing by way of completing and pressing the mailing in a pressing roller arrangement. This is achieved without smudging or smearing of the mailing, and is carried out under a controlled force, while still making allowance for variations and inconsistencies in the thickness of the folded mailing. Other advantages and characteristics of the apparatus are described below.

In view of the failure of the prior art to provide a fully satisfactory mailing machine capable of providing a mechanism for accurately folding and pressing a large number of sheets into a compact array for insertion into a mailing envelope, it is an object of the present invention to provide a high speed mailing apparatus having an improved folding, creasing and pressing mechanism.

Another object of the invention is to provide, in combination, a folding and creasing mechanism and an improved pressing mechanism for a plurality of folded sheets.

A further object of the invention is to provide an improved pressing mechanism for use in pressing a mailing assembled and folded by an automated mailing machine.

A still further object is to provide a folding system combined with a pressing apparatus which includes a pair of opposed, continuously driven rollers adapted to press the folded-over sheets so as to maintain them in a compressed condition for subsequent insertion into a mailing envelope.

Yet another object of the invention is to provide a folding apparatus which includes a folder bar intermittently movable in an arc from a position beneath a portion of a paper stack to a position overlying a creasing foot or jaw adapted to rise and press the sheets against the folder bar to impart a crease to the mailing, in combination with a pair of opposed, continuously driven pressing rollers located downstream of the folder.

Another object of the invention is to provide a pressing roller mechanism which includes upper and lower pressing rollers driven synchronously and having their outer surfaces urged into closely spaced apart rotation by an adjustable tensioning mechanism.

A still further object of the invention is to provide a pressing roller arrangement for use in an automated mailing machine wherein a first roller is supported in fixed relation to a table and the second roller overlies the first roller, and is supported for pivotable movement by a swing arm mechanism permitting adjustment of roller position and facilitating synchronous drive of the rollers.

Yet another object of the invention is to provide a pair of pressing rollers which are urged together by a resilient spring action but which are movable to a widely spaced apart position for replacement or maintenance by the use of a novel toggle arrangement for alternately locking and releasing the rollers.

A further object of the invention is to provide a roller tensioning arrangement useful with a roller movably mounted on a swing arm, wherein the tensioning arrangement includes a toggle link secured to the axle of one roller, a toggle arm pivotally mounted to the link and secured to the axle of the other roller, with the link of the arm being arranged such that the pivotable connection between the arm and the link moves between locked and opened positions by moving over center with respect to an extension of a line extending between the axles about which the two pressing rollers rotate.

Another object of the invention is to provide a roller support and drive system which includes first and second, fixed axis roller drive elements, a first pressing roller with a fixed rotational axis, and a second pressing roller carried by a swing arm which has one end mounted for pivoting movement about the axis of the second roller drive element, a positive drive connection between the first drive element and the first roller, and the second drive element and the second roller, with the first and second drive elements also having portions engaged with each other to insure synchronous rotation of the drive elements and their associated rollers, regardless of the positions of the rollers themselves.

A still further object of the invention is to provide a pressing roller arrangement having a fixed axis roller and a movable axis roller, with the movable axis roller and the fixed axis roller being urged together by a toggle arrangement which includes a toggle link having a closed end portion encircling the axis of one roller, an intermediate portion only partially encircling the other roller axis, and another end portion partially attached to a toggle arm journaling the axle of the movable axis roller for rotation about its own axis, with the toggle link and arm being arranged so that the pivot point moves over center with respect to the projection of a line extending between the axes of the two rollers, whereby a change in the gap between the two rollers may be accommodated during normal use and whereby the toggle arm may be pivoted with respect to the link to release the tension urging the rollers together and permit the movable roller to be raised freely.

Yet another object of the invention is to provide a roller control arrangement wherein the two pressing rollers are urged together by a spring-tension toggle arrangement which permits ready adjustment of the initial spacing between pressing rollers.

A further object of the invention is to provide a toggle arrangement for a pair of opposed rollers wherein the tension biasing the rollers together may be adjusted by a simple mechanism.

A still further object of the invention is to provide a pressing roller arrangement wherein the axle of one roller extends through and is journaled by a pair of arms forming a part of a toggle linkage arrangement and wherein a handle extends between the toggle arms to facilitate manipulation of the roller.

Another object of the invention is to provide a pressing roller arrangement in a mailing machine in which one roller is protected by a shroud forming a part of a toggle linkage which secures the roller in place during use.

Yet another object of the invention is to provide a pressing roller arrangement which may be readily added to existing mailing machines using intermittent conveyors and insert stations and wherein said rollers may be associated in use with the folding and creasing station forming a part of such machine.

The invention achieves the foregoing and other objects and advantages of the invention by providing a mailing machine having a machine frame, a table, a plurality of insert stations disposed adjacent the table, a conveyor having one run extending parallel to the table and having spaced apart elements for engaging and moving individual mailings along the table, with the machine further including a mailing, folding and creasing station and a pressing roller station having a pair of opposed pressing rollers actuated by a common drive arrangement and biased toward a closely spaced apart position by a resilient, releasable toggle clamp arrangement. The invention further achieves its objects by providing a pressing roller arrangement for use with a folder station wherein one of a pair of pressing rollers is carried by a movable swing arm and the other is fixed, and wherein each roller is driven separately but synchronously from a common source.

The exact manner in which the foregoing and other objects and advantages of the invention are achieved in practice will become more clearly apparent when reference is made to the following detailed description of the preferred embodiment of the invention set forth in the specification and shown in the accompanying drawings, in which like reference numbers indicate corresponding parts throughout.

Figure 5:
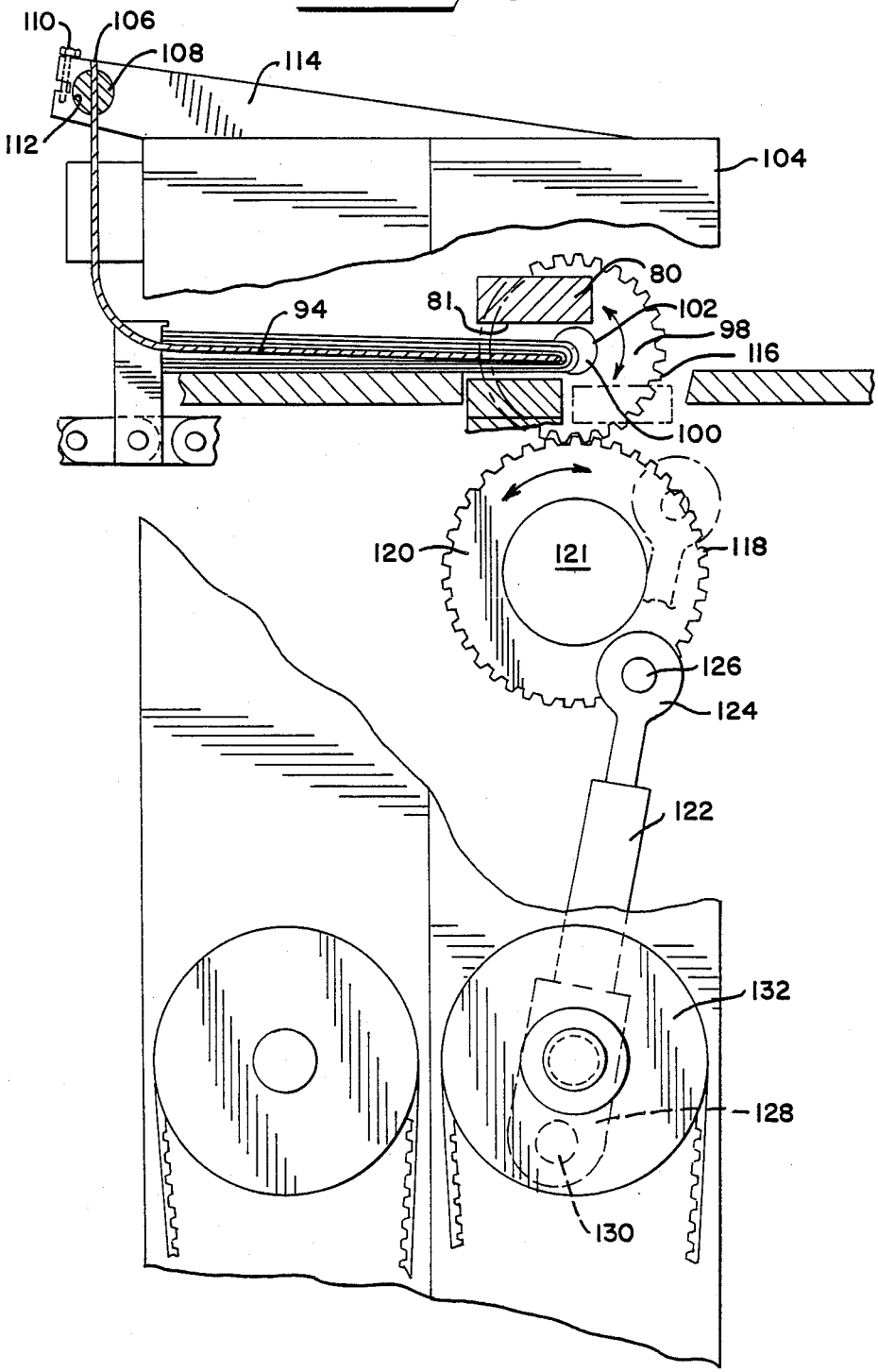
Figures 6, 6A:
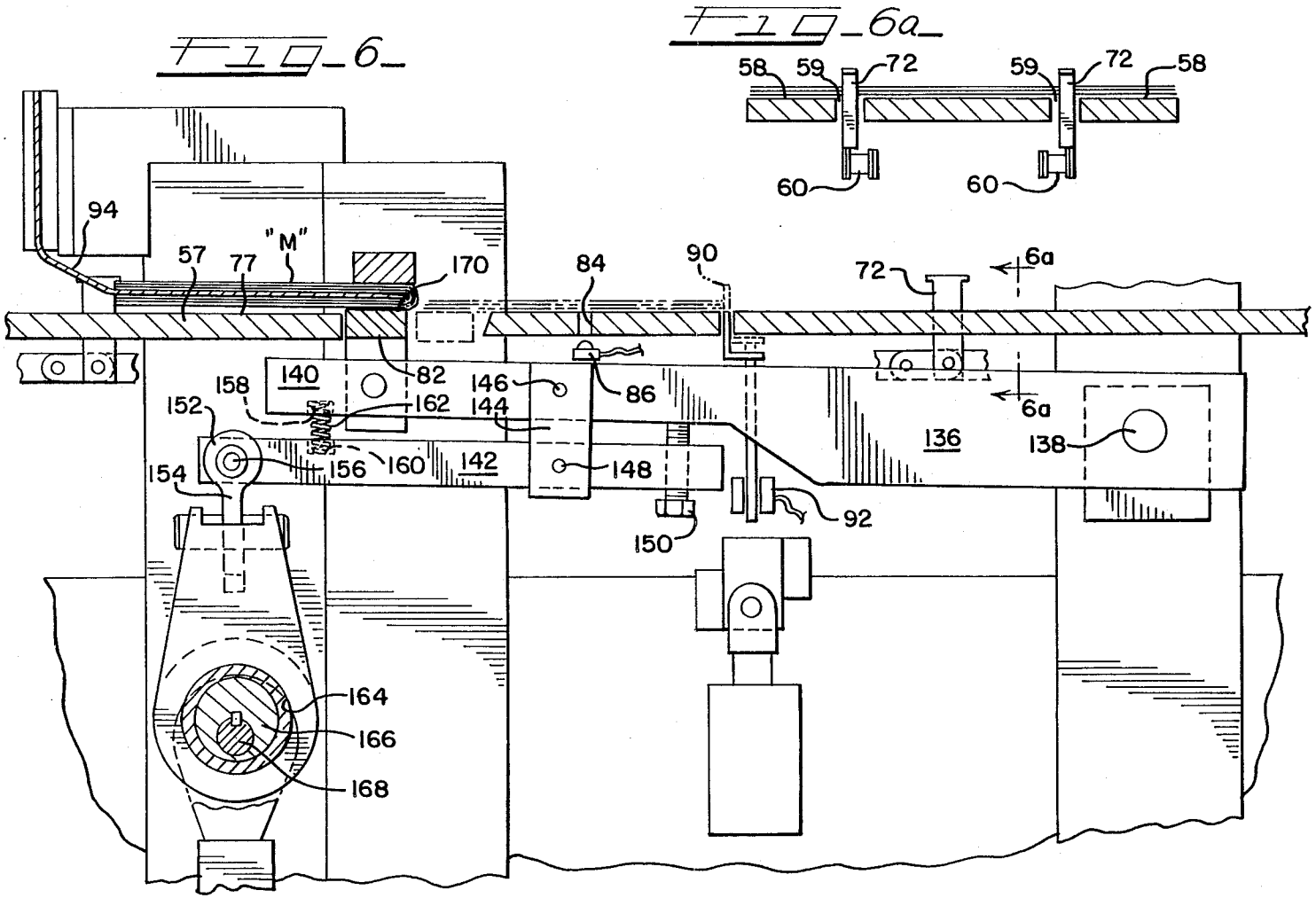
Figure 7:
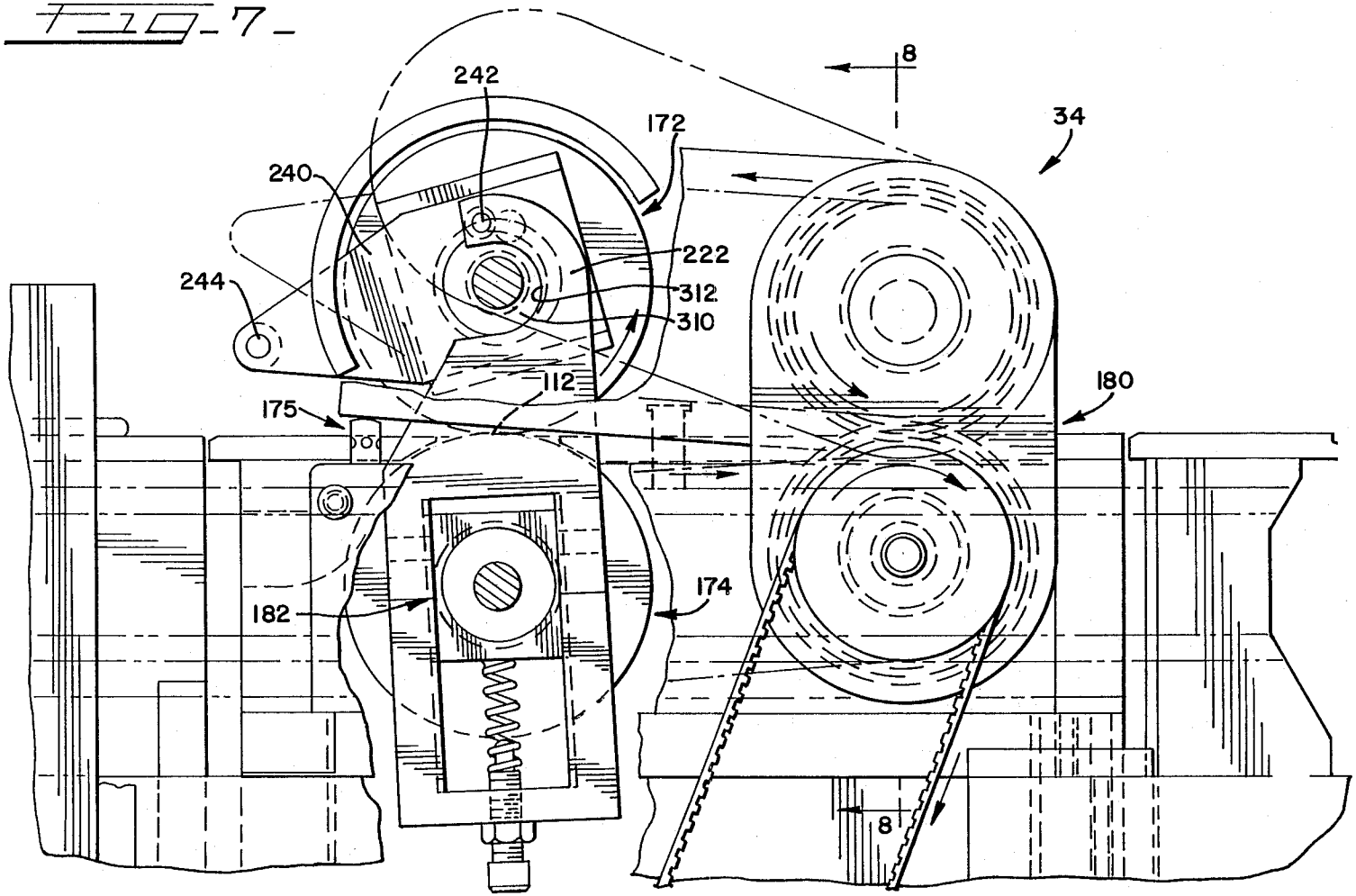
Figure 8:
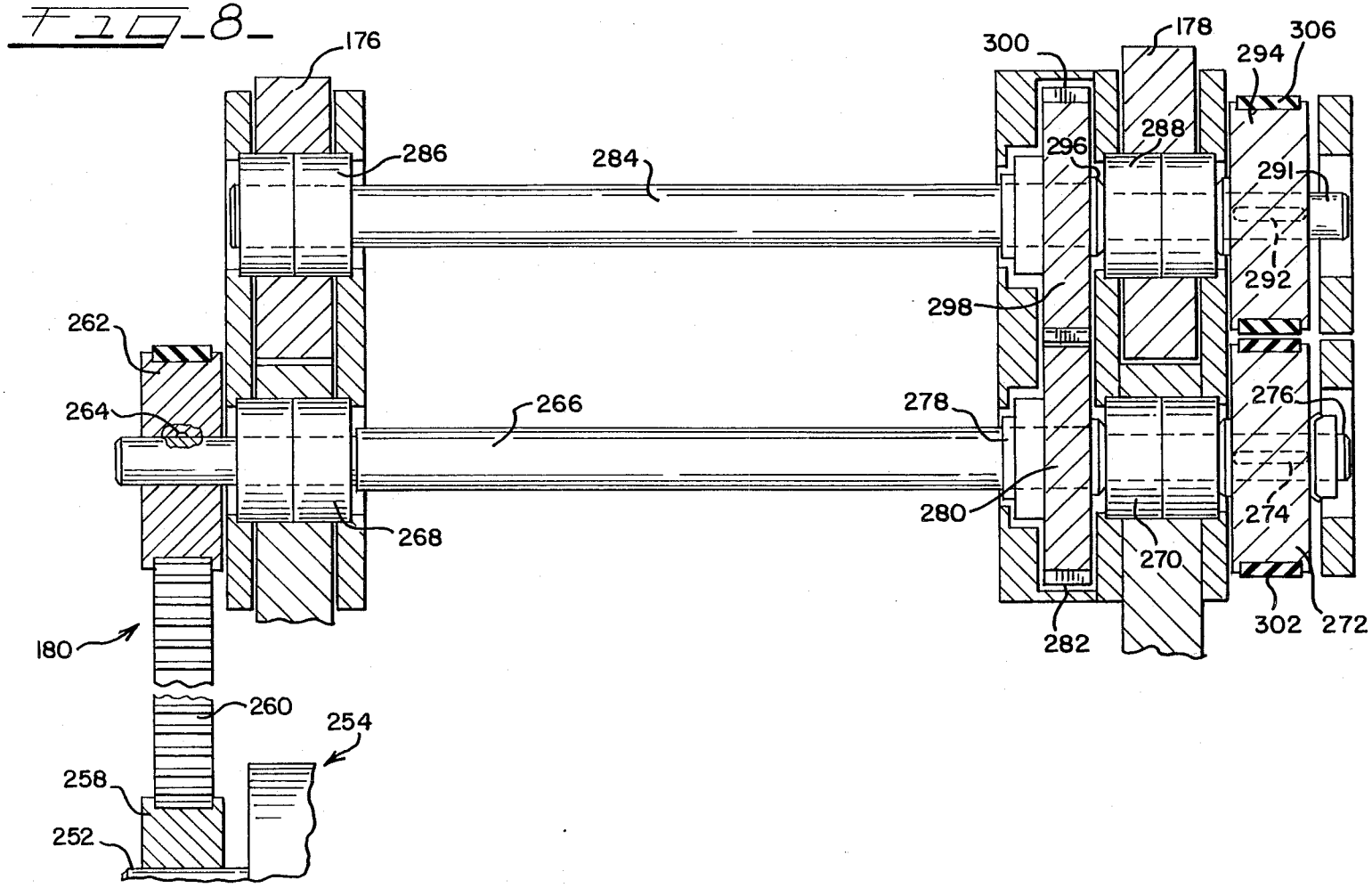
Figure 9:
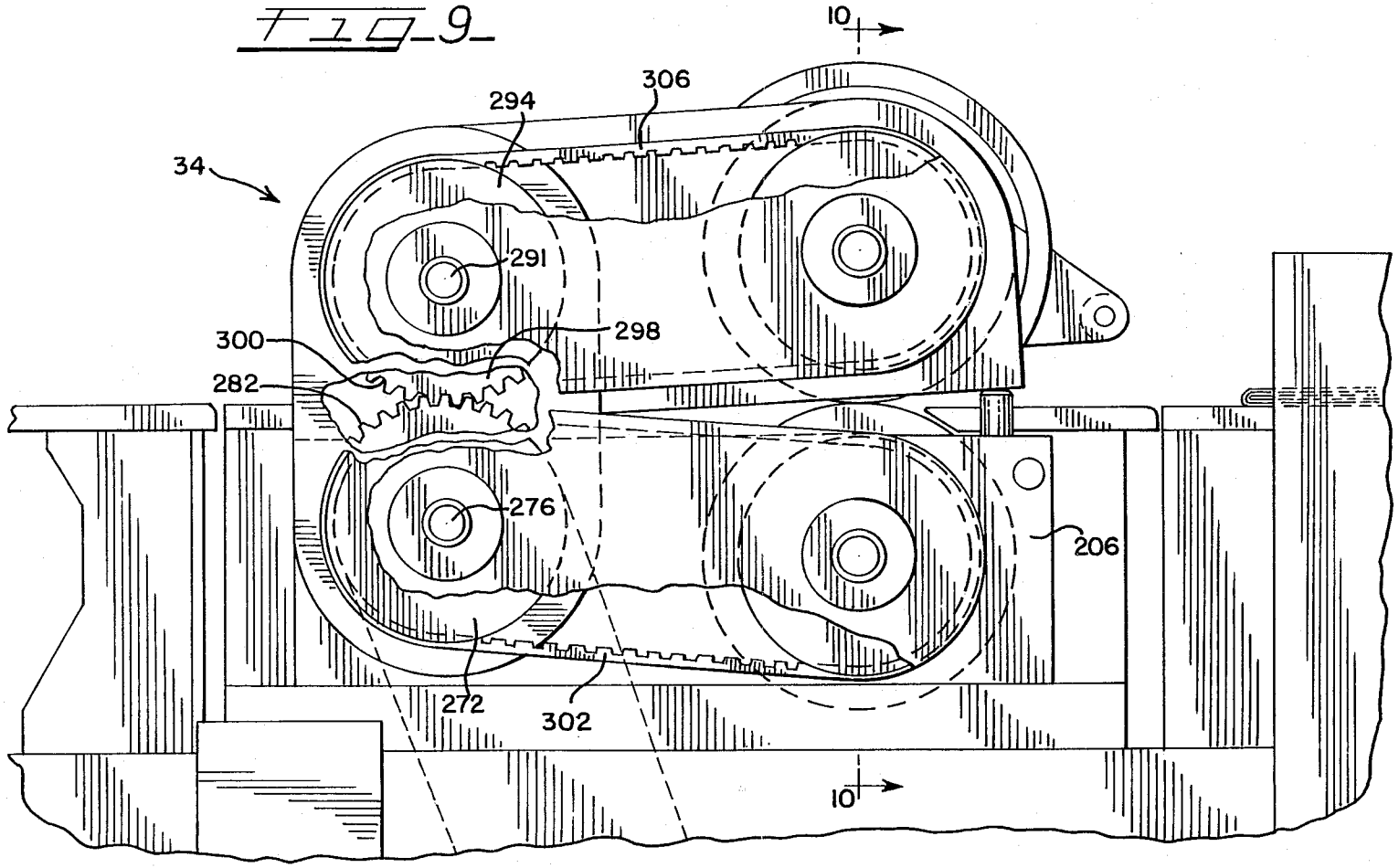
Figure 10:
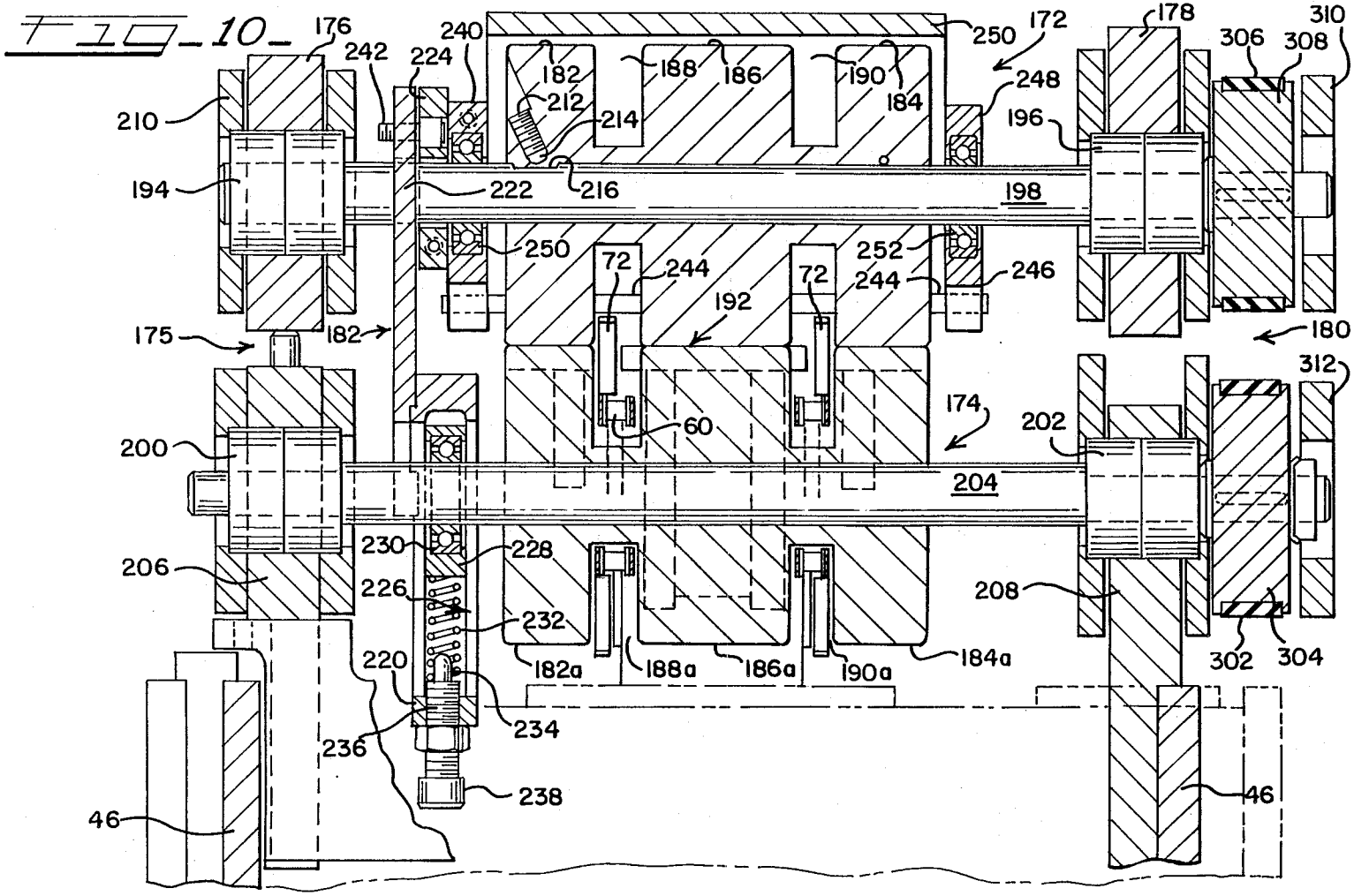

FIGS. **4*a*–4*e*** are diagrammatic views showing a sequence of operation involved in folding the mailing prior to the time it is presented to the roller assembly for final pressing;

FIG. 5 is an elevational view, partly in section and partly in elevation, showing the folder bar and creasing foot assembly of the present invention;

FIG. 6 is a fragmentary side elevational view, with portions in section, showing the operation of the lower or creasing foot element of the folder apparatus;

FIG. **6*a* is a vertical sectional view, on a reduced scale and taken along lines 6*a*—6*a* of FIG. 6**, showing a portion of the conveyor table of the invention;

FIG. 7 is a side elevational view, with portions broken away and showing portions in section, of the pressing roller assembly of the invention and the drive arrangement therefor;

FIG. 8 is a vertical sectional view of the drive system used to actuate the rollers of the invention and taken along lines 8—8 of FIG. 7;

FIG. g is a fragmentary side elevational view, with portions broken away showing the roller and roller drive assembly of FIG. 7, taken from the opposite side thereof;

FIG. 10 is a vertical section view of the pressing roller assembly of the invention, taken along lines 10—10 of FIG. 9; and FIGS. **11*a*–11*d*** are side elevational views, partly in section and partly in elevation, and diagrammatically showing the over-center action by which the pressing rollers are placed and maintained under tension.

DESCRIPTION OF THE PREFERRED EMBODIMENTS OF THE INVENTION

While the invention may be embodied in a number of different machines, and may be used for applications other than automated mailing, a detailed description of the invention will be made in relation to a mailing machine having a longitudinally extending frame, a table for supporting being-formed mailings, a pair of parallel spaced apart chains with pusher bars forming a conveyor system and equipped with one or more top feed type insert stations for periodically feeding inserts to the mailing as it progresses along various stations on the track. Such insertion machines or their components are currently manufactured by the Kern Corporation of Switzerland and are sold by the assignee of the present application.

Figure 1:
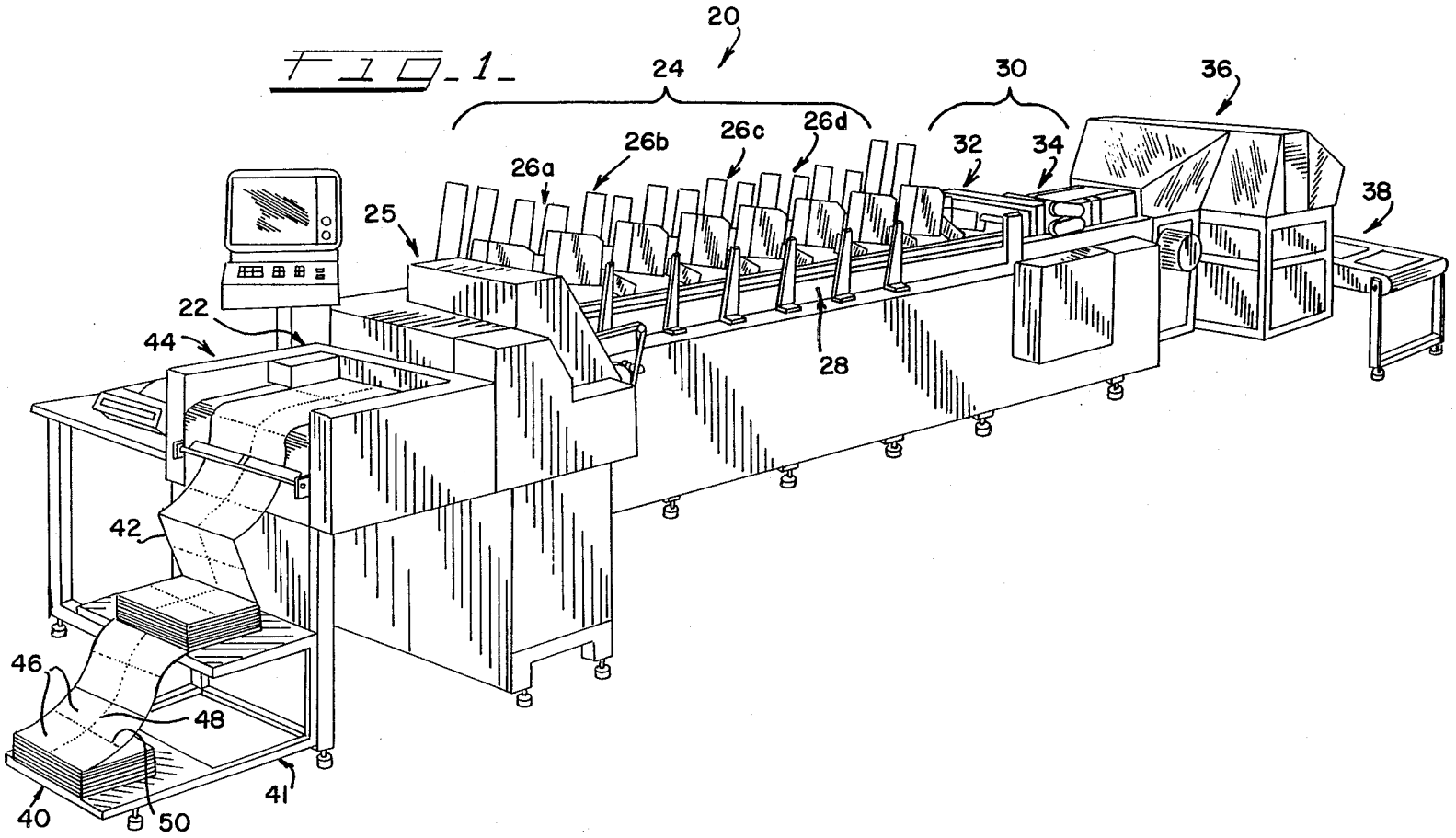
FIG. 1 is a perspective view of a mailing machine incorporating the novel folding and pressing apparatus of the invention.

Referring now to the drawings in greater detail, FIG. 1 is a perspective view of a mailing machine generally designated 20 and shown to embody the invention The machine 20, from a functional standpoint, is subdivided into a number of areas, including a document feeder-separator area generally designated 22, and a plural-station insert area generally designated 24 and shown to include a plurality of individual insert stations, each generally designated 26*a*, 26*b*, etc. The stations 26*a*, 26*b*, etc., are shown to be positioned above a main conveyor assembly generally designated 28.

A folder-creaser area generally designated 30 forms one part of the mailing machine 20 and this area is subdivided into an area containing a folding and creasing station generally designated 32 in FIG. 1, and which, in turn includes a folding and creasing mechanism described further herein. Downstream of the folding and creasing station 32 is a pressing station generally designated 34. This station 34 includes a roller mechanism also described in detail elsewhere herein. After the contents of a mailing have passed these stations 32,34, they customarily pass to a stuffer/classifier area generally designated 36. Thereafter the sealed envelopes are customarily accumulated on an outfeed table generally designated 38. In some cases, the packages are otherwise dealt with for subsequent mailing. FIG. 1 shows that the feeder-separator area 22 customarily includes a stack, generally designated 40, of individual master pages 42 arranged in continuous, bifold form for feeding to a slitter 44 or other mechanism for subdividing the individual master pages 42 of the stack 40 into individual bill sheets 46. This is accomplished bY tearing the master pages 42 along longitudinal and lateral lines 48, 50 in the slitter 44. Hence, each master page 42 becomes four more individual sheets 46.

As is known to those skilled in the art, a package of the type processed by a high speed automated mail processing machine 20 customarily contains individualized bill elements sent to a particular addressee; such bills might be telephone bills, for example, or may be financial statements such as those furnished by a brokerage house or an insurance company. In any case, the entire package sent to the customer contains a mailing which in turn is made up of individual bill pages, and which further includes other materials. These include, for example, a the return envelope and one or more inserts, including data processing cards, explanatory preprinted material, advertising, or the like, it being understood that such inserts are not individualized for a particular customer, as are the bill pages. Normally, each customer may receive a mailing containing several bill pages, in some cases up to 5, 10, 15 or more individual bill pages, where a high level of billing activity is reflected, in addition to a preset or otherwise determinable number of inserts. It is highly desirable that even where the entire mailing-aggregates 10 or 15 pages, for example, it be folded as a single unit rather than as two or three separate units.

Figure 2:
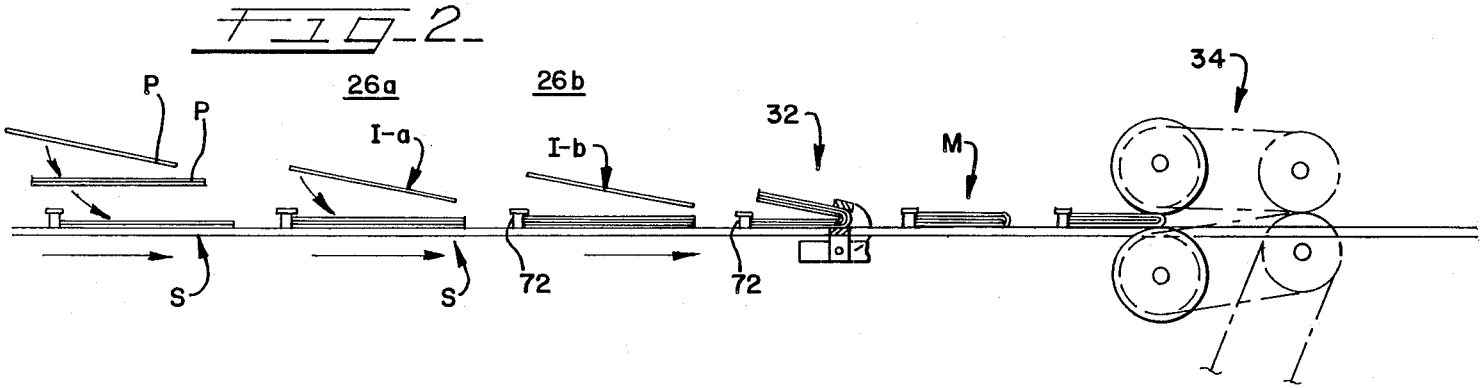
FIG. 2 is a diagrammatic view showing various steps in assembling a mailing, folding the mailing, and pressing the folded mailing by means of the roller system of the invention.

Referring now to FIG. 2, a very generalized schematic view of certain steps of the inventive process appear. On the left, several individual bill sheets here designated P are shown to be in the process to being fed to a stack S of bill sheets, such as would occur at or near the feeder separator area 22 of the machine of FIG. 1. These bill sheets are shown here for illustration purposes only as being fed individually, but it is understood that the bill element portion of the stack S may alternately have been preformed in another location and fed to the conveyor as a unit.

In any event, the next step is the addition of one insert page Ia, shown as coming from station 26*a*. This adds one additional sheet to the stack of pages comprising the mailing. At a subsequent insert station 26*b*, an insert Ib is added to the stack, it being understood that any number of inserts, such as 2–10 or more, could be added to the mailing from each of a number of additional stations 26*c* . . . 26*n*, for example, in this way. Subsequently, the stack S comprising the mailing is advanced to the folder-creaser station 32, where a fold and a crease are imparted to the stack of documents S in a manner which will be described in greater detail elsewhere herein. After leaving the station 32, all of the contents of the mailing M have been assembled and a fold has been imparted such that the entire contents of the mailing lie on the interior of a single, folded over, exterior sheet of paper.

The lower face of this exterior sheet preferably contains the addressee information for that mailing, and hence the billing address will be visible through a window in a mailing envelope. Subsequently, the folded mailing "M" advances to the roller presser station 34 of the invention, where a permanent crease and final thickness reduction are imparted to the mailing M as it passes through the opposed pressing rollers.

Figure 3:
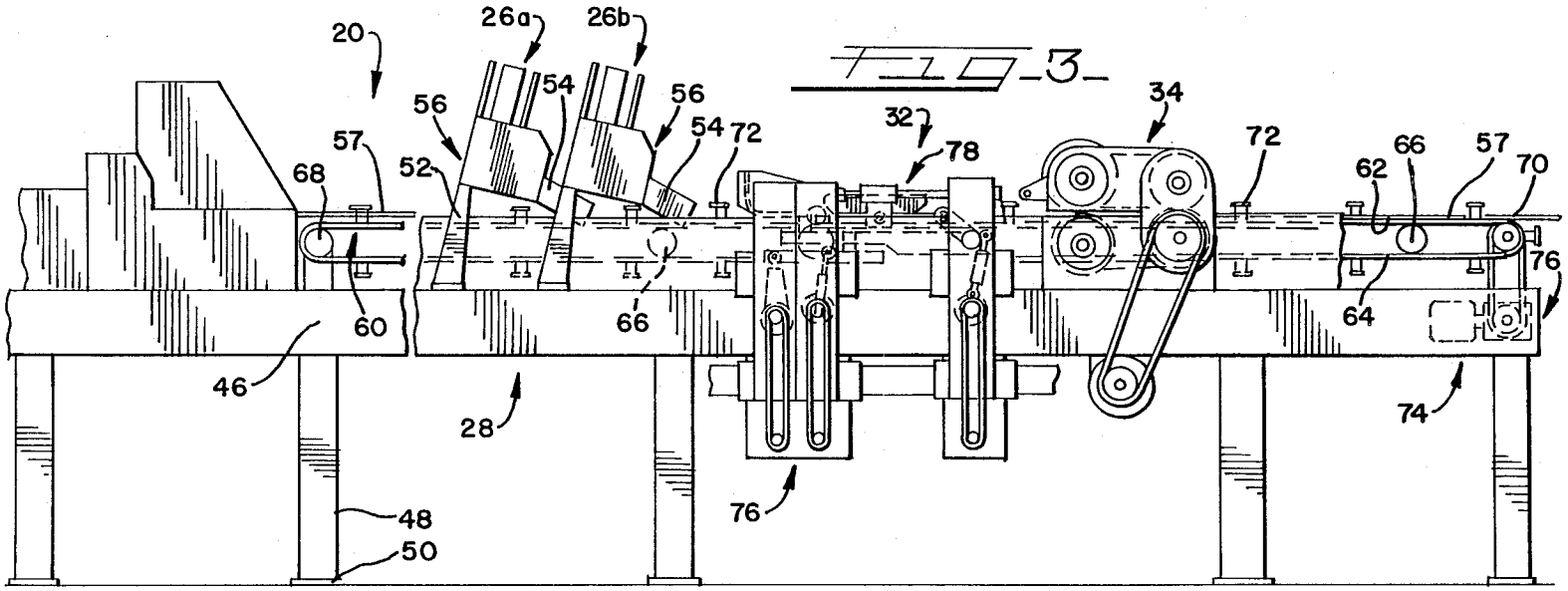
FIG. 3 is a fragmentary side elevational view of one form of apparatus of the invention, showing the positioning of the folding and roller pressing elements of the invention in relation to the remainder of an automated mailing machine which includes a table, a conveyor system with a motor drive and a plurality of individual insert stations and related machine components.

Referring now to FIG. 3, certain additional details of the main conveyor assembly 28 of the machine 20 are shown. The conveyor assembly 28 preferably includes one or more horizontally extending frame members 46 supported by individual legs 48 having pedestals 50 on the respective bottom portions thereof. The inserter units 26*a*, 26*b*, etc. are positioned by upstanding braces 52 whose lower ends are secured to the frames. An inclined belt-type conveyor unit 54 forms a part of each of the insert units 26*a*, 26*b*, etc. and each such unit further includes a hopper which is generally designated 56 for receiving a plurality of inserts I-a, I-b, etc.

Another principal element of the conveyor unit 28 is a table generally designated 57 and shown to include a plurality of individual table track elements 58; these track elements 58 are spaced apart, as will be detailed later herein, to provide longitudinal slots 59 (FIG. 6*a*) for passage of the pusher bars 72 or other parts of the conveyor needed to advance the mailing as it is being made up and processed. The conveyor unit perferred for use with the invention is preferably made up from an endless length of roller chain generally designated 60 and shown to be divided into upper and lower runs 62, 64. The chain 60 is trained over a plurality of idler sprockets 66, including an end idler sprocket 68 and a conveyor chain drive sprocket 70. At spaced apart intervals along the chain are individual links 70 to which are affixed pusher bars 72 for engaging the trailing edges of the mailing M to advance the mailing intermittently along the travel path of the conveyor to the stuffer-classifier area 36 (FIG. 1).

FIG. 3 shows a drive motor generally designated 74 forming a part of an intermittent drive system 76. This intermittent conveyor drive is of a type known to those skilled in the art to provide an intermittent cyclic motion of the chain, advancing the mailing M a predetermined distance in each operating cycle. When the conveyor chains are transiently immobile, inserts are made in a known manner to each of the existing, being-formed mailings along the length of the track and at the upstream end of the conveyor. As a particular being-formed mailing is advanced along the path of the track, an insert is (or may be) added each time the conveyor is stopped at an insert station. When all inserts have been added, the mailing is ready to be folded, creased and pressed.

FIG. 3 also shows, in generalized form, the folder-creaser assembly 32 and the roller-presser mechanism 34. A fold retainer generally designated 78 is also shown. This is an optional feature in the form of one or more leaf springs or plates which transiently hold the upper surface of the folded-over mailing in its folded condition until it reaches the roller-presser station 34.

Figures 4A, 4B, 4C, 4D, 4E:
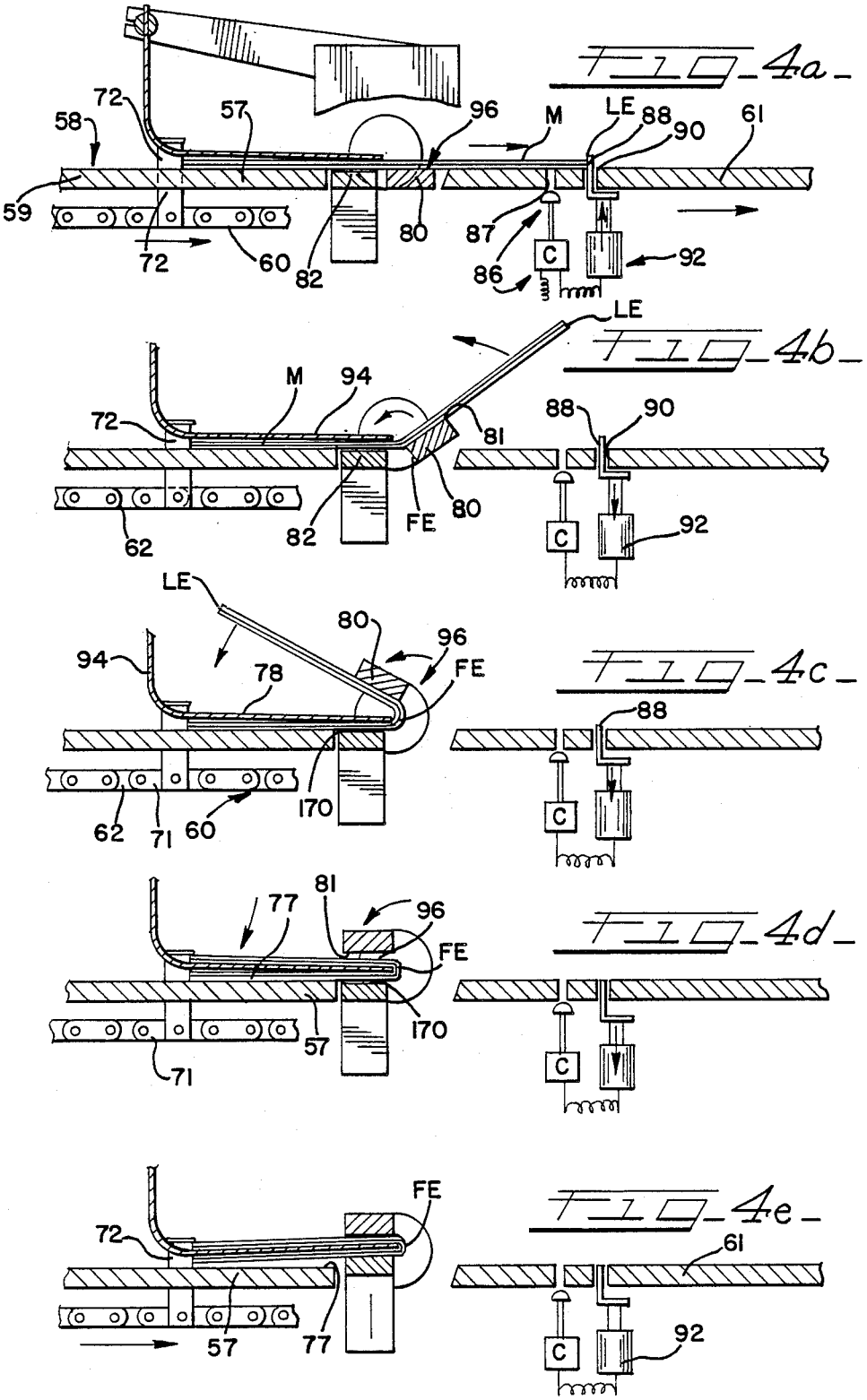

Referring now to FIGS. 4*a–e*, a generalized, somewhat schematic view of the operation of the folder-creaser station and its principal elements are shown. In FIG. 4*a–e*, it will be assumed that the conveyor movement is to the right and that a mailing generally designated M and comprised of a plurality of individual sheets is being advanced from left to right over the table track element 58. In addition to the spaced apart table tracks 58, there are disposed along the level of the table a folder bar 80, and a creaser foot 82; these elements serve as jaws to engage the mailing M and impart a fold to what becomes a leading edge thereof. In addition, in a perferred form of apparatus, one of the table track elements 58 includes an aperture 84 beneath which is disposed a detector, such as a photodiode type optical detector 86 for controlling the timing of the folding and creasing operation. FIGS. 4*a–3* show a stop element 88 positioned so as to be reciprocable through a stop element opening 90 in one of the table track segments 58 under the control of a solenoid 92.

FIGS. 4*a–4d* show the folding sequence which occurs in the operation of the machine.

Here, as the pusher bar 72 advances the mailing M in the direction shown by the arrow (downstream), the beam from the photodiode 86 is interrupted by the leading edge LE of the mailing M. This signals a control unit C to actuate the solenoid g2, thus raising the stop element 88 through its associated opening g0. This engagement of the leading edge of the mailing positions this mailing as desired, axially condensing or compressing it if necessary. A holddown spring unit 94, comprised of a plurality of spring leaves spaced apart across the width of the conveyor table, insure that the trailing half or upstream end of the mailing M is prevented from moving vertically.

As the conveyor unit finishes a forward movement stroke and the stop element 88 remains raised, insuring that the leading edge LE of the mailing M is precisely positioned, a timer (not shown) rotates the drive system generally designated g6 for the folder bar 80, causing the bar surface 81 to lift and fold portions of the mailing in the sequence shown first in FIGS. 4*a* through *d*. As the folder bar 80 reaches the limits of its rotational travel, and just as its normally upper or sheet-engaging face 81 becomes horizontal, the timing circuit 96 actuates a mechanism which raises the creaser foot or lower jaw 82 above the surface of the table so as to form the folded edge FE of the mailing M into the beginning of a crease.

When this cycle is completed, the solenoid 92 is deenergized, and the stop element 88 drops to a lowered position beneath the plane of the top of the surface of the table track segment 58. This sequence is repeated for each following mailing M; the pusher bar 72 advances a folded and creased mailing M downstream or in the direction of the roller-presser station 34 as the following mailing is being fed to the folder-creaser station 32.

Before referring to the operation of the roller presser station 34, however, reference will be made to FIGS. 5 and 6, which show respectively preferred forms of the above-described folder bar operation in detail.

Referring now to FIG. 5, the folder bar 80 is shown to include a paper-engaging, normally upwardly directed face 81 which extends between and lies chordwise, i.e., offset from the center of, an opposed pair of oscillating bar carrier gears 98. These oscillating gears rotate about the axis of stub shafts 100 which are journaled in bearings 102 disposed in a folder frame bracket 104. One or more leaf springs g4 are disposed above and in closely spaced apart relation to an upper surface 77 of the table track segment 58 across which the mailing M passes. The spring leaves g4 have their end portions 106 located on a transverse bar 108 which is clamped by fasteners 110 in an opening 112 in an arm 114. This arm 114 is pivotally secured to the frame bracket 104 so as to permit the springs g4 to be lifted and pivoted away or positioned atop the being-formed package.

As is further shown in FIG. 5, one of the bar folder carrier gears 98 is a driven gear which has affixed to a portion thereof a plurality of gear teeth 116 forming a part thereof and adapted to engage counterpart teeth 118 on an oscillating drive gear 120 positioned beneath the gear 98. The oscillating drive gear 120 moves about the axis of a stub shaft 121 when a connecting rod 122 is moved. The rod 122 has an upper portion 124 encircling a crank pin 126 disposed on the drive gear 120 and offset from the center thereof The lower end portion 128 of the connecting rod 122 is journaled for movement with a lower crank pin 130; the crank pin 130 in turn is moved when the wheel 132 is actuated by a intermittent drive clutch (not shown) but which engages the gear 132 for the purpose of causing a singe cycle oscillation initiated by the control "C" which works with the solenoid 92.

In the use of these elements, upon receipt of a proper signal, the clutch drive is engaged and the wheel 132 rotates clockwise, pulling the gear 120 through an arc of perhaps 180° of clockwise rotation. This, by reason of the comparative sizes of gears 120, 98, causes approximately 180° counterclockwise rotation of the wheel 98, in turn causing the folder bar to move to the raised and inverted position as shown in FIG. 5. In this position, the lower surfaces of the stack of documents comprising the mailing M has been engaged by the bar and folded over as schematically illustrated in FIG. 4*b–d*. The papers comprising the stack are thus folded about the down stream end of the leaf spring g4, and the folder bar surface 81 lies above the now-folded stack of documents.

Referring now to FIG. 6, there is shown the mechanism for operating the presser foot or lower jaw unit 82. FIG. 6 shows certain of the elements which are also shown in FIG. 4*a–d* and in FIG. 5, including the table track elements 58 with their upper surfaces 77, the opening 84 for the optical detector 86 and the opening 90 for the stop element 88. The flexible holddown springs 94 are also shown, as is the solenoid 92 for operating the stop element 88.

As shown in FIG. 6, the lower jaw 82 is also actuated by a power drive mechanism in sequence with the operation of the folder bar mechanism This entire assembly includes a lower jaw carrier 136, which is pivotally mounted about a fixed shaft 138. The movable end 140 of the carrier 136 is secured to the jaw unit 82. Beneath the lower jaw carrier 136 is an actuator 142 which is secured by a pair of tie bars 144. The upper end of each tie bar 144 is fixedly secured, as at 146, to the carrier 136, while a pin element 148 pivotally mounts the other end portion of the bar 144 to the actuator 142. The right hand or remote portion of the actuator is spaced from the undersurface of the carrier 136 by an adjusting screw 150 whose end portion engages the carrier 136. The proximate end of the actuator 142 is secured to an end portion 152 of a connecting rod 154. The end 152 of the rod 154 encircles a crank pin 156 on the outer end of the actuator 142. A pair of opposed pockets 158, 160 are formed respectively in the jaw carrier 136 and the actuator 142; the pockets engage opposite ends of a stiff tension spring 162 which biases the actuator apart from the carrier 136. The lower end of the connecting rods 154 includes an enlarged diameter channel opening 164 which surrounds an eccentric drive plate 166 which is keyed to a rotary shaft 168.

In use, when the shaft 168 is rotated by engagement with a drive clutch (not shown) the drive plate 166 rotates, forcing the large end of the connecting rod 154 to rise, carrying the crank pin 156 and the end of the actuator 142 upward. This raises the jaw carrier 136 and the jaw 82 until the upper surface 170 of the lower jaw 82 contacts and raises the lower surface of the paper sheets forming a part of the mailing until the sheets are tightly gripped between the jaws, i.e., the opposed surfaces 170, 81 of the jaw and the folder bar 82 80. This action finishes the fold which was initiated by the folder bar 80 and imparts a crease to the mailing.

The sequencing of this action is controlled so that as soon as the upper surface 81 of the folder bar 80 is horizontal and in overlying relation to the paper surfaces, the lower jaw rises rapidly and imparts a blow or folding action to what has by then become the folded edge "FE" of the paper stack. Only after the stack has advanced to the next station does the shaft 168 return. The return stroke then re-positions the lower jaw 82 with its upper surface 170 parallel to the upper surface 77 of the table track elements 58, where it awaits repetition of a cycle.

Referring now to a principal element of the invention, the roller-presser assembly of the invention, generally designated 34 in FIGS. 1 and 3, is shown in detail in FIGS. 7–11.

Referring now in particular to FIGS. 7, 9 and 10, details of the roller-presser assembly generally designated 34 are shown. The major elements include upper and lower rollers, generally designated 172, 174, left and right hand upper roller support swing arms generally designated 176, 178, a roller drive system generally designated 180, and a toggle-type tensioning and roller release assembly generally designated 182.

In use, the upper and lower rollers 172, 174 are urged together by the novel toggle-type holddown system, but the lower limits of upper roller movement may be adjusted by auxiliary means 175 (FIGS. 7 and 9) to insure that the mailing passing through the apparatus is not marked or damaged.

Referring now to FIGS. 7, 9 and 10, it is shown that the upper roller 172 includes left-hand, right-hand and center segments 182, 184, 186 spaced apart by reduced diameter center sections so as to provide radially extending slots 188, 190 permitting passage therethrough of the pusher bars 72. This insures that the conveyor unit 28 may continue to urge the mailing forwardly along its travel path during and after the time the mailing passes in the nip 192 between the rollers 172, 174. The lower roller 174 also includes counterpart roller segments **182*a*, 184*a*, 186*a* and slots 188*a*, 190*a* to facilitate passage of both the upper and lower runs 62,64 of the conveyor chain 60**.

The upper roller 172 is journaled for rotation relative to the swing arms 176,178 by bearing assemblies 1g4,196 in the respective ends of a roller axle shaft 198. The lower roller 174 is journaled for rotation in bearing assemblies 200,202 encircling a rotary axle shaft 204. The bearing assemblies 200,202 are secured in carrier plates 206,208 affixed to frame members 46. In the embodiment shown, the bearings 194, 196, 200, 202 are not arranged to take thrust and therefore the swing arms or carrier plates may be equipped with end caps 210 for this purpose; only one such end cap is numbered, it being understood that as many as are needed may be provided and that all are identical in function.

FIG. 10 shows that a set screw 212 for locking the roller 172 to the shaft 198 has a nose portion 214 extending into a slot or keyway in the shaft 216; counterpart structure or its equivalent exists, but is not shown, to secure the lower roller 174 to the lower shaft 204.

Referring to another important feature of the invention, FIG. 10 shows certain construction features of the invention, specifically the toggle-type roller holddown and tension release assembly 182.

Referring now also to FIGS. 7 and 11, this assembly 182 is shown to include a toggle assembly generally designated 218 which includes a lower link portion 220, an intermediate link portion 222 and an upper portion 224. The lower link portion 220 includes a slot 226 which receives and positions a link positioner 228 carrying a bearing 230 which encircles the lower shaft 204. The link positioner 228 is normally urged upwardly by a compressible spring 232. The lower end of the spring 232 may be moved by engagement with a shoulder 234 on the shank 236 of an adjustment screw 238. Hence, upward movement of the link 218 relative to the shaft 204 can be achieved only by compression of the spring 232, the preload on which may be adjusted as just described.

Referring in particular to FIGS. 7, 10 and 11, it is shown that a left-hand toggle arm 240 is affixed to the upper end 224 of the link 218 by a pivot pin 242 extending between the elements. This toggle arm 240 includes, at the end thereof which is directed upstream of the conveyor, a transverse handle 244 which extends to and joins the forward end 246 of the right-hand or companion toggle arm 248. According to the preferred form of the invention, a semicircular shroud 250 is carried by and extends between the toggle arms 240,248. As is shown, each of the left and right-hand toggle arms 240, 248 respectively carries a roller bearing assembly 250, 252 encircling the shaft 198. The operation of the toggle link mechanism just described is described in detail elsewhere herein.

Referring now to FIGS. 8, 9 and 10, the synchronous roller drive system generally designated 180 and embodied in the invention is shown in detail.

FIG. 8 shows a drive motor 254, a primary drive stub shaft 256, and a primary drive pulley 258 adapted for cooperation with a primary drive toothed belt 260 running over a primary driven pulley 262. The driven pulley 262 is keyed as at 264 to a countershaft 266 journaled in bearings 268, 270 which are secured to the machine frame. A toothed belt roller driving pulley 272 is keyed as at 274 to the end portion 276 of the countershaft 266, while an intermediate portion 278 of the shaft 266 carries the inner diameter of a primary drive gear 280 having plural teeth 282 on its outer diameter.

The elements just described, in cooperation with other elements to be described, form the driving arrangement for the lower roller 174.

Referring again to FIG. 8, it is shown that an upper shaft 284 extends between the downstream ends of swing arms 176, 178, and is journaled therein by bearing assemblies 286,288. An outer end 290 of the shaft 284 is keyed as at 292 to an upper roller driving pulley 294, while the intermediate portion 296 of the shaft 284 is keyed to a shaft driven gear 298, the teeth of which 300 engage the teeth 282 on gear 280. According to the foregoing arrangement, therefore, meshing of the gears 280, 298 insures synchronous rotation of the shafts 266,284, and this in turn causes rotation of the upper and lower roller driving pulleys 294, 272 respectively.

Referring to FIGS. 9 and 10, it is shown that a lower roller drive belt 302 is trained over the pulley 272 and over a lower roller driven pulley 304. An upper roller drive belt 306 is trained over the pulley 294 and also the upper roller driven pulley 308. FIG. 10 shows that protective shrouds 310, 312 may be placed over the drive belts 302, 306.

Referring now to FIGS. 11*a–d*, the operation of the toggle mechanism is shown. Here, in FIG. 11*a*, the rollers 172, 174 are shown as contacting each other or having minimal spacing in the nip 192 therebetween. The toggle link 218 is shown to be configured such that a recess 310 is defined by a curved sidewall 312 formed in the intermediate portion 222 of the link 218. The recess 310 accommodates the axle 198 of the upper roller, which is journaled relative to the toggle arm 240. According to the invention, the pivot pin 242 joining the end portion 224 of the link 218 to the toggle arm 240 normally lies on one side (in this case, the upstream side) of an extension 314 of an imaginary line L extending between the centers of the axles 198, 204. As shown in FIGS. 11*a*–11*d*, the center line axis of the upper shaft 198 swings through an arc having a center coincident with the axis of the pivot pin 242. As a consequence, the axis of the pivot pin 242 will be farthest from the axis of the lower axle shaft 204 when the pin 242 lies on a line between the center lines of the axles 198, 204. If the pivot pin is to either side of an extension 314 of such a line "L", the center lines of the pivot pin 242 and the lower axle 204 are closer together. Consequently, movement of the pin 242 to either side of this line extension will result in lowering the compressive load on the biasing spring 232.

Figures 11A, 11B, 11C, 11D:
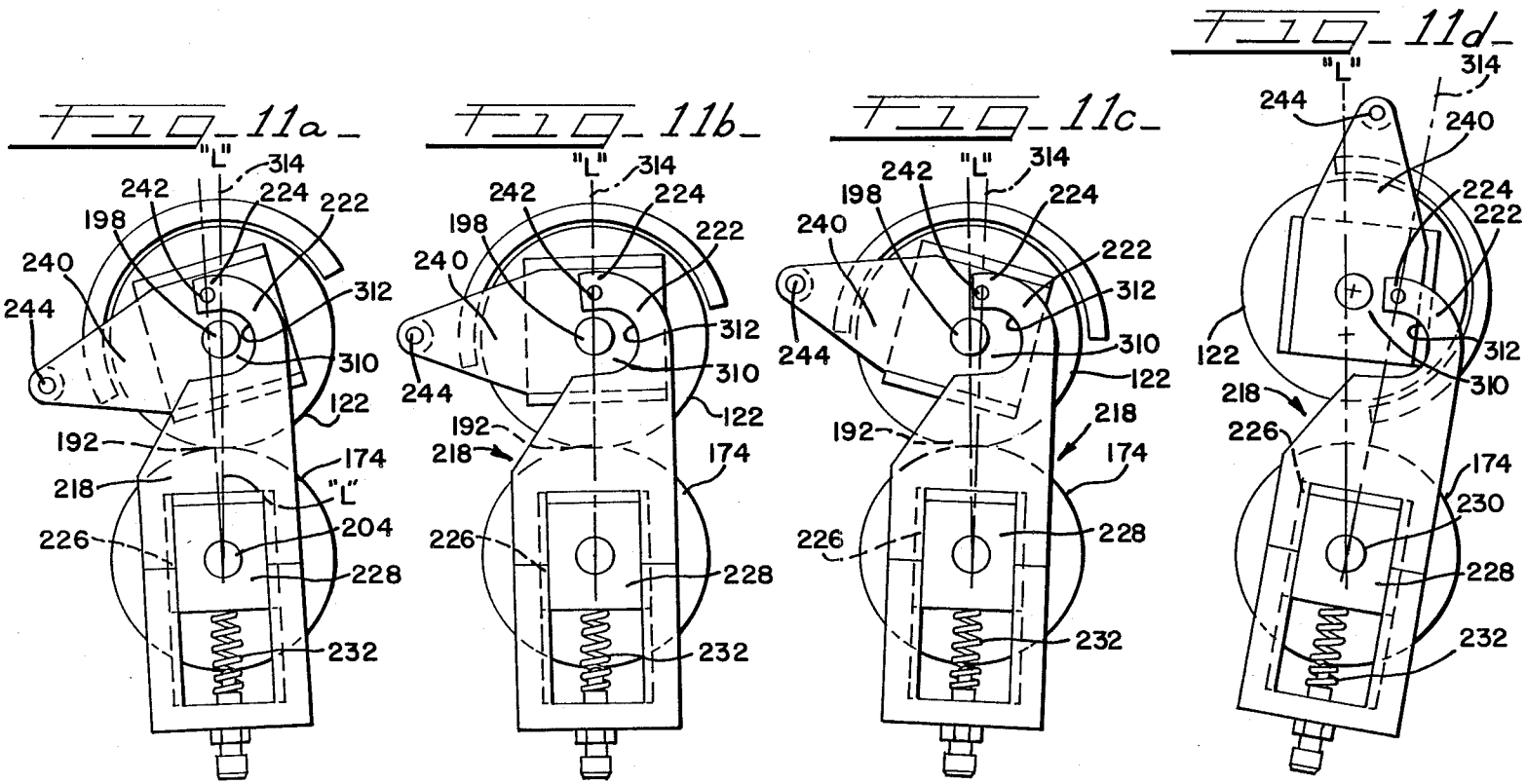

FIG. 11*b* shows that rotation of the toggle arm 240 and raising the handle 244 is resisted by the force of spring 232. FIG. 11*c* shows these forces beginning to diminish as the upper axle 198 swings counterclockwise about the pivot axis of the pin 242 and partially out of the recess 310. FIG. 11*d* shows that fully raising the handle 244 permits the roller to be raised further.

FIG. 11 also illustrates that the raised roller, which can be further raised significantly by still further movement of the link 240 facilitates roller removal or adjustment. While not shown in FIGS. 11*a–d*, it will be understood that movement of the swing arms 168, 178 accompanies the movement of the upper roller axle 198.

However, and very importantly, because of the drive arrangement just described, the dive connections need not be disabled or their synchronous connection interrupted merely because the rollers are moved apart, even a large distance. Also of importance is that the toggle action permits the upper roller to be safely locked in the raised position.

Referring now in general to the operation of the machine, it is believed the operation may easily be understood in reference to the foregoing description of the machine components. To synopsize the operation of preparing a mailing, however, reference is again made to FIGS. 1–10 of the drawings. Here, it will be assumed that an array or stack 40 of documents in bifold form is positioned on a holder generally designated 41 in FIG. 1. The larger bill pages 42 are advanced and unfolded in the slitter 44 where they are subdivided into individual bill sheets 46. While not shown in detail in FIG. 1, it will be understood that the individual pages or sheets 46 are accumulated in groups according to addressee at a bill assembly station generally designated 25. Here, after all the sheets intended for a particular addressee have been assembled, they are forwarded, as by way of a cross feed conveyor or other known means, and deposited in groups on the conveyor 28. Each group of individualized documents thus forms a part of the stack of documents S shown in FIG. 2. As the conveyor assembly 28 is intermittently advanced along its travel path, additional individual articles are fed from insert stations, such as the stations 26*a*, 26*b*, etc. As the pusher bars 72 forming parts of the conveyor 28 advance the stack, a given set of documents is presented to the folder/creaser station 32. Here, under control of the photodetector 84 and associated circuitry described above, the stack S is stopped with its leading edge precisely positioned; the folder bar 80 and the creasing foot or lower jaw 82 cooperate as previously described to impart a fold and crease to the stack about its transverse center line.

On the next machine cycle, the pusher bars advance the stacks beneath a holddown arrangement or fold retainer 78 (FIG. 3) insuring that the stack does not unfold during the transport portion of the machine cycle.

Thereafter, the stack S is fed into the nip 192 between rollers 172, 174. The rotating rollers seize and propel the folded stack forward to the next station, which may be a station whereat a subsequently positioned mailing envelope is opened and the stack inserted therein. This process, as well as those above-described steps of assembling and forming the mailing, are known to those skilled in the art. By reason of the novel pressing roller arrangement, including the provision of the fine adjustment screw 175 (FIGS. 7 and 10) for the initial positioning of the upper roller 172, sufficient pressing force may be applied to a stack of documents to insure that they are properly compacted and do not provide excess resistance to sealing the mailing envelope. The screw stop 175 also limits travel of the toggle arms to limit roller tension.

The rollers engage opposed surfaces of the mailing, but because of their synchronous rotational velocity, do not smudge or tear the contents as might occur at high speed if the pressing operation were conducted by stationary elements. The multiple segments 182, 184, 186, in the rollers, as best shown in FIG. 10, provide compatibility with the conveyor advance and return arrangement.

The toggle mechanism, combined with the shroud, provides safety and convenience in use as well as an adjustable tensioning feature Positioning the upper roller axle within the link recess provides a convenient, simple arrangement for repositioning the roller while retaining the integrity of the swing arms, axles, and drive connections.

The present invention is capable of handling much larger stacks of mailed material than were able to be assembled and stuffed using otherwise similar or identical prior art equipment.

It will thus be seen that the present invention provides an improved high speed sheet folder and presser system for use in automated mailing systems, which system has a number of advantages and characteristics, including those pointed out herein and others which are inherent in the invention. A preferred construction having been shown, bay way of example, it is anticipated that modifications and variations to the described form of apparatus will occur to those skilled in the art and it is anticipated that such variations or modifications may be made without departing from the spirit of the invention or the scope of the appended claims.

I claim:

1. A mail processing machine which includes a generally planar table having an upper surface for supportingly engaging the lower surface of the sheets comprising individual mailings to be processed by said machine, a conveyor unit having upper and lower runs disposed beneath said table, a plurality of spaced apart means each extending above said table upper surface and adapted to engage the trailing edge of an individual mailing comprised of an array of superimposed flat sheets, and an intermittent drive for advancing said engaging means in a given direction so as to move said individual mailings downstream of said machine along the plane of said table, said processing machine further including a folding station having means overlying a portion of said table upper surface and adapted to engage the upper surface upstream portion of said array of sheets, a folder bar extending transversely of said given direction, said folder bar having a surface portion normally lying beneath and engaging a part of the lower surface of the downstream part of said stack, said bar being accurately movable to a position overlying said upstream portion of said array to impart a fold to said array about an imaginary line lying between said trailing edge and the leading edge of said array, a creasing element movable from a position generally coplanar with said upper table surface to a position thereabove to crease said array by engaging its upper and lower surfaces with said creaser element and folder bar respectively, and a pressing roller assembly comprising a pair of opposed pressing rollers having exterior surface portions adapted, in the use of the machine, to engage the respective upper and lower surfaces of said array of sheets passing along said table and through the nip between said rollers, each of said rollers having associated therewith its own drive mechanism, and means for insuring synchronous operation of said drive mechanisms, whereby the peripheral velocity of said rollers comprising said pair is the same, said pair of rollers being movable with respect to each other but normally urged together by resilient means so as to apply a desired degree of pressing force to such array of sheets passing there between.

2. A mail processing machine as defined in claim 1, in which each of said opposed pressing rollers comprise a roller having individual segments spaced apart by reduced diameter intermediate sections so as to provide plural slots in said rollers for accommodation of said engaging means.

3. A mail processing machine as defined in claim 1, wherein said means for insuring synchronous operation of said drive mechanisms comprise a pair of substantially identical drive gears in meshing relation, each of said gears having associated therewith in positive drive relation a driving pulley for its associated roller.

4. A mail processing machine as defined in claim 1, wherein each of said rollers include a driven element associated therewith, wherein a separate driving element is provided for each roller, and wherein said driving and driven elements for each roller are operatively connected by a positive drive element.

5. A mail processing machine as defined in claim 4 wherein said positive drive element comprises a toothed belt unit.

6. A mail processing machine as defined in claim 4, wherein both of said roller driving elements are synchronously rotated by means of an associated drive gear, said associated drive gears being positioned in meshing relation.

7. A mail processing machine as defined in claim 1, wherein said resilient means urging said rollers together comprises a toggle clamp arrangement having a link portion carrying an element encircling the axis of one roller and a toggle arm having an element encircling the axis of the other roller, said arm and said link being pivotally attached to each other by an over-center mechanism 8. A mail processing machine including a machine frame, a conveyor with upper and lower runs, plural spaced apart advancing means on said conveyor, each of said advancing means being adapted to engage a trailing edge of a mailing comprising a stack of foldable sheets and urge said mailing along a path parallel to the upper run of said conveyor by an intermittent movement action, a stack support table disposed above the upper run of said conveyor and including spaced apart support surfaces adapted to permit passage of said advancing means, a folding and creasing mechanism including means for engaging parts of the leading and trailing portions of the stack, folding said stack upon itself and imparting a crease thereto generally about its transverse midline, and, spaced downstream of said folding and creasing mechanism, a pressing roller mechanism, said pressing roller mechanism including upper and lower pressing rollers, a pressing roller axle shaft supporting each roller, the axis of one of said roller axle shafts being fixed with respect to said machine frame, and the axis of the other roller axle shaft being supported by a pair of opposed swing arms, each having an axle shaft-carrying end portion and an opposite end portion, each of said opposite end portions having means mounting said swing arm for pivotable movement about a swing arm pivot axis, a drive system for each of said pressing rollers, said drive system including a rotary driving element for each roller and a rotary driven element for each roller, one of said rotary driving elements being coaxially arranged with respect to said swing arm pivot and the other element being journaled for rotation relative a fixed point on said machine frame, means providing a positive drive connection between said driving and driven rotary elements, respectively, means for synchronizing the movement of said driving elements with respect to each other, and a roller drive motor and positive drive connection between said roller drive motor and one of said rotary driving elements, whereby said rollers may be driven in use independently of the relative positions of their axle shaft axes.

9. A mail processing machine as defined in claim 8, wherein said means providing said positive drive connection comprises toothed belt units and wherein said driving and driven rotary elements are pulleys constructed and arranged for cooperative driving engagement with said belts.

10. A mail processing machine as defined in claim 9, wherein said means for synchronizing said movement of said driving elements comprise a driving gear and a driven gear, said gears having their teeth in meshing relation, said driving and driven rotary elements being respectively arranged coaxially in relation to said driving and driven gears.

11. A mail processing machine as defined in claim 10, which further includes a drive shaft for said driving element for said lower roller and a drive shaft for said driving element for said upper roller, said driving and driven gears respectively being secured for rotation with respect to said shafts.

12. A mail processing machine as defined in claim 8, wherein each of said upper and lower pressing rollers has individual segments spaced apart by reduced diameter intermediate sections so as to provide plural slots in said rollers for accommodating said spaced apart advancing means on said conveyor.

13. A mail processing machine as defined in claim 8, which further includes means resiliently urging said upper pressing roller downwardly toward a position wherein its outer periphery will engage the outer periphery of said lower roller.

14. A mail processing machine as defined in claim 8, which further includes resilient means urging said rollers together, said means comprising a toggle clamp arrangement having a link portion carrying an element encircling the axis of one roller, (and spring means biasing said element toward said pivotal connection means), a toggle arm having an element encircling the axis of said other roller, means forming a pivotal connection between a part of said arm and an end portion of said link, said toggle link, toggle arm, and toggle arm element being arranged such that said other roller axis is movable over center in respect to a line extending between said one roller axis and said pivot point.

15. A mail processing machine including a machine frame, conveyor with upper and lower runs, plural spaced apart advancing means on said conveyor, each of said advancing means being adapted to engage a trailing edge of a mailing comprising a stack of foldable sheets and urge said mailing along a path parallel to the upper run of said conveyor bY an intermittent motion, a stack support table disposed above the upper run of said conveyor and including spaced apart support surfaces adapted to permit passage of said advancing means, a folding and creasing mechanism including means for engaging parts of the leading and trailing portions of the stack, folding said stack upon itself and imparting a crease thereto generally about its transverse midline, and, spaced downstream of said folding and creasing mechanism, a pressing roller mechanism, said pressing roller mechanism including upper and lower pressing rollers, a pressing roller axle shaft supporting each roller, the axis of one of said roller axle shafts being fixed with respect to said machine frame, and the axis of the other roller axle shaft being supported for relative movement, and a toggle clamp arrangement resiliently urging said pressing roller axle shafts toward each other for controlling the pressing force applied to said stack of sheets positioned between said rollers, said toggle clamp arrangement including a link and an arm pivotally connected to each other, and a spring element resiliently urging said rollers together, said spring element further alternately permitting said upper pressing roller axle to be locked into, and released from, engagement with said resilient urging means, thereby permitting said rollers to be resiliently held together during operation and released from connection of maintenance and adjustment by pivoting said upper roller about said pivotable connection between said link and said arm.

16. A mail processing machine as defined in claim 15, wherein said toggle link includes a link frame and a slide plate, said link frame including a channel therein arranged to permit sliding movement of said slide plate, spring means having one portion fixed with relation to said link plate and another portion movable with said slide plate, said link element including a recess formed in said link between the point at which said arm is pivotally connected to said link and said portion of said link receiving said slide plate.

17. A mail processing machine as defined in claim 15, which further includes a second arm positioned with respect to said upper roller, said machine further including a roller positioning handle extending between said arms.

18. A mail processing machine as defined in claim 17, which further includes a protective shroud having portions affixed to each of said arms, said shroud further including a principal portion of generally partially cylindrical form, said shroud overlying portions of said upper roller in the use of said machine.

19. A toggle mechanism for resiliently urging the axle shaft of a pair of opposed pressing rollers together, said mechanism including a toggle link frame, a toggle arm, a pivotable connection between said toggle arm and said toggle link frame, and a slide plate disposed within a portion of said toggle link frame and confined therein so as to permit movement only along the axis of said frame between the ends of said frame, means resiliently urging said slide plate towards said pivotable connection, said slide plate having a portion surrounding a portion of one of said roller axles, said toggle arm having a portion surrounding the axle of said other roller, and a recess disposed in said link frame between the portion thereof receiving said slide plate and the portion forming said pivotable connection, whereby said axle of one roller may move into and out of said recess by a pivoting movement with said other axle being thereby movable to either side of a line between said one axle and said pivotable connection, said movement thereby altering the distances between said axles and thereby varying the force on said spring.

20. A toggle mechanism as defined in claim 19, which further includes a second toggle arm, said first and second toggle arms each having an end portion remote from said portion surrounding said axle, and an operating handle extending between said arm end portions to facilitate movement of said roller.

21. A toggle mechanism as defined in claim 19, which further includes a second toggle arm also having a portion surrounding said axle of said other roller, and a protective shroud extending between portions of said toggle arms so as to cover a portion of said other roller.

* * * * *